US005769101A

United States Patent [19]

Iwata

[11] Patent Number: 5,769,101

[45] Date of Patent: Jun. 23, 1998

[54] HAIR BUNDLING CORE AND METHOD OF USING THE CORE

[75] Inventor: Hidenobu Iwata, Sagamihara, Japan

[73] Assignee: Yonesho Company, Ltd., Tokyo, Japan

[21] Appl. No.: 825,914

[22] Filed: Apr. 2, 1997

[30] Foreign Application Priority Data

Apr. 2, 1996 [JP] Japan ..... 8-079734

[51] Int. Cl.[6] ..... A45D 8/04; A45D 8/34; A45D 8/36

[52] U.S. Cl. ..... 132/273; 132/200; 132/276; 132/212; 132/210

[58] Field of Search ..... 132/200, 210, 132/213.1, 214, 148, 255, 256, 264, 273, 280, 281, 54, 55, 212, 276, 282, 283

[56] References Cited

U.S. PATENT DOCUMENTS

| | | | |
|---|---|---|---|
| 980,021 | 12/1910 | Tauss | 132/130 |
| 1,016,007 | 1/1912 | Glowacki et al. | 132/130 |
| 3,108,604 | 10/1963 | Krull | 132/273 |
| 3,126,017 | 3/1964 | Sidelman | 132/273 |
| 4,031,907 | 6/1977 | Rogers | 132/255 |
| 4,270,554 | 6/1981 | Lazarro | 132/281 |

*Primary Examiner*—Gene Mancene
*Assistant Examiner*—Philogene Pedro
*Attorney, Agent, or Firm*—Oliff & Berridge, PLC.

[57] ABSTRACT

A hair bundling core structure comprises an elastic cylinder for letting a hair bundle to pass therethrough, which cylinder is split by a rift, and a hair fastening pin connected to a lower end portion of the elastic cylinder by an attachment member at a side opposite to the rift. The hair fastening pin has a plurality of shafts for thrusting into the hair bundle and is allowed to move between a first position in which the shafts tend parallel to an axis of the elastic cylinder and a second position in which the shafts tend perpendicular to the axis. The elastic cylinder is formed of a foamed synthetic resin having a thickness and strength which are sufficient for facilitating an piercing of a hair fixing U-shaped pin and an extraction of the same from the elastic cylinder.

16 Claims, 11 Drawing Sheets

HAIR BUNDLING CORE AND METHOD OF USING THE CORE

BACKGROUND OF THE INVENTION

1. Field of the Invention

The present invention relates to a hair bundling core structure and method of using the core structure for making a bundled hair style in setting hair, more particularly an erected or set-up hair style.

2. Related Art

For dressing the hair into the set-up style, it is an ordinary practice, in the prior art, to take a prescribed amount of a lump of fine fibers which are made of synthetic resin and make them round neatly into a core by one's hands, and to fix the core to the hairs by means of clamping pins such as bell-shaped pins at a place where a base of the hair style is to be made. And then, a lump hair style is completed by covering the core with hair tresses, combing the tresses and arranging the leading end portions thereof, and fixing them at a prescribed place to the other part of hairs by means of the clamping pins.

Moreover, for making the hair style bulky, it is a conventional method to comb a bundle of hairs backward, i.e. from the leading portion of the bundle to the root portion of the same to bristle up the hairs. It is an ordinary practice to use the back-combing and the core in a preferable combination.

Since the aforementioned operations require a considerable skill, the applicant of the present invention proposed a hair bundling core structure in a previous U.S. application Ser. No. 08/550,399. The hair bundling core structure comprises an elastic cylinder made of a foamed synthetic resin having a thickness and strength which are sufficient for facilitating a piercing of a hair fixing U-shaped pin and an extraction of the U-shaped pin from the elastic cylinder and are capable of fixing hair to the elastic cylinder by the piercing of the U-shaped pin, wherein said elastic cylinder is cut from its one end surface to the other end surface thereof to form a rift.

By the use of the hair bundling core structure, the hairdo can be made by the following steps. Firstly, an operator sets hairs in a preset range of a human's head into a hair bundle, binds the root portion of the bundle by means of a fastening instrument such as a rubber band, and then pinches the root portion on the two, left and right, or back and forth sides of the binding by clamping pins such as the bell-shaped pins. Secondly, the rift of the elastic cylinder is opened to form a gap, through which the lower portion of the hair bundle is inserted into the elastic cylinder to let the hair bundle to pass therethrough. The core structure can be fixed on the head at the root portion of the hair bundle by piercing one of the two legs of the U-shaped pin into the core structure and by thrusting the other of the legs below the clamping pins, i.e. between the clamping pins and a head skin. The core structure facilitates the setting of the desirable bundled hair style by fixing and setting hair tresses on the structure itself, since it is easy to pierce the U-shaped pin into the core structure.

However, the prior art hair bundling core structure have following points to be improved.

In the conventional hair bundling core structure, the user have to get ready at least two types of pins, the U-shaped pin and the clamping pins besides the core structure itself. Moreover, when the user make the hair style of her or his own head, it is relatively difficult to pinch the root portion of the hair bundle by oneself at the two sides thereof by means of the clamping pins. Furthermore, there is a demand for setting a desired hair style rapidly in certain circumstances such as in a contest for beauty artists. For this purpose, it is required to shorten the time for the setting operation compared with that in a case the clamping pins are used.

SUMMARY OF THE INVENTION

The primary purpose of the prevent invention is to provide an improved hair bundling core structure which enables a simple operation without the clamping pins, and shorten the time for setting the hairs. For achieving this purpose, the hair bundling core structure according to this invention comprises an elastic cylinder which has a hole for letting the hair bundle to pass therethrough and is provided with a rift, and a hair fastening pin which is connected to the lower portion of the elastic cylinder by means of an attachment member and has a plurality of parallel shafts for thrusting into the hair bundle. In stead of the above-mentioned clamping pins, the hair fastening pin is thrusted into the root portion of the hair bundle and acts as an anchor of the elastic cylinder, by thrusting one leg of the U-shaped pin between the hair fastening pin and a skin of the head and by piercing the other leg of the U-shaped pin into the elastic cylinder, such that the elastic cylinder is firmly fixed on the head. Although several clamping pins must be attached to the root portion one by one, the hair fastening pin can be fixed to the root portion of the hair bundle by a single thrusting operation, such that the time for setting the hairs is shorten. The elastic cylinder may be replaced by an elastic bar with a rift or a notched groove, if desired.

The secondary purpose of the present invention is to provide a hair bundling core structure which facilitates the setting of the user's hair by oneself. For achieving this purpose, the hair fastening pin and the rift are arranged at a pair of diametrically opposite sides of the elastic cylinder, and the hair fastening pin is allowed to move between a first position in which the plurality of shafts tend into a direction parallel to an axis of the elastic cylinder and a second position in which the shafts tend into a direction perpendicular to the axis. In this structure, the user can install the hair bundling core structure to the hair bundle, by thrusting the shafts of the hair fastening pin to the root portion of the hair bundle in the first position, and opening the rift to form a gap, and then shifting the direction of the elastic cylinder with respect to the hair fastening pin into the second position to let the lower portion of the hair bundle to enter into the elastic cylinder through the gap. By these operations, the user can fix the structure to the hair bundle by oneself without difficulty.

The third purpose of the present invention is to provide each shaft of the hair fastening pin with a plurality of protrusions and recesses alternating in its lengthwise direction for facilitating the thrusting of the leg of the U-shaped pin below the hair fastening pin and supporting the leg firmly. In other preferable mode of this invention, each shaft is so curved as to achieve the same purpose.

The fourth purpose of the present invention is to provide a hair bundling core structure with a hair fastening pin removably attached to the elastic cylinder or the elastic bar. The hair fastening pin can be replaced, when the elastic cylinder or the elastic bar is deteriorated by repeating the piercing of the U-shaped pin or broken by some reason. As the result, the hair bundling core structure according to this invention is economical and the effective use of resources is accomplished.

The fifth purpose of the present invention is to provide the elastic bar with the notched groove for clamping the hair bundle therebetween so as to facilitate the handling of the hair bundle.

The sixth purpose of the present invention is to provide a method of using the above mentioned hair bundling core structure, in which the user can set one's hair into the bundled hair style efficiently by oneself.

The further other purposes of the present invention will become apparent in the following explanation of the present invention.

DESCRIPTION OF THE PREFERRED EMBODIMENTS

Hereinafter, the mode of the invention is explained in accordance with the attached drawings.

Figure 1:
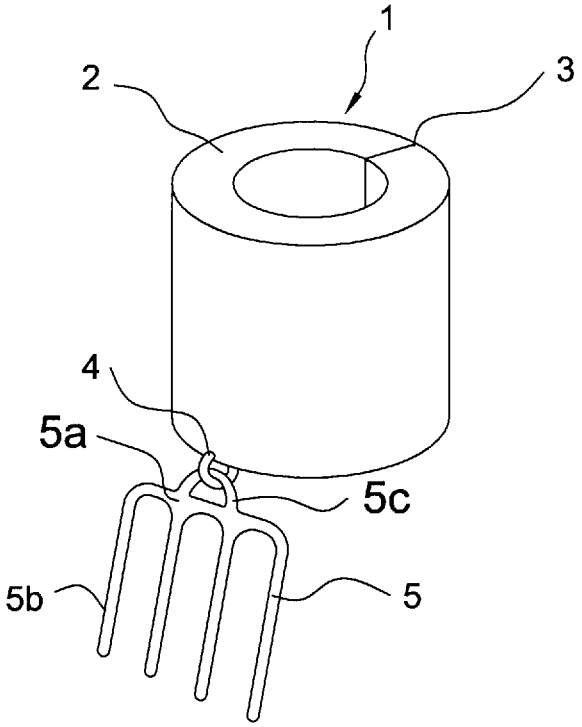
FIG. 1 is a whole, perspective view of the hair bundling core structure.
Figure 2:
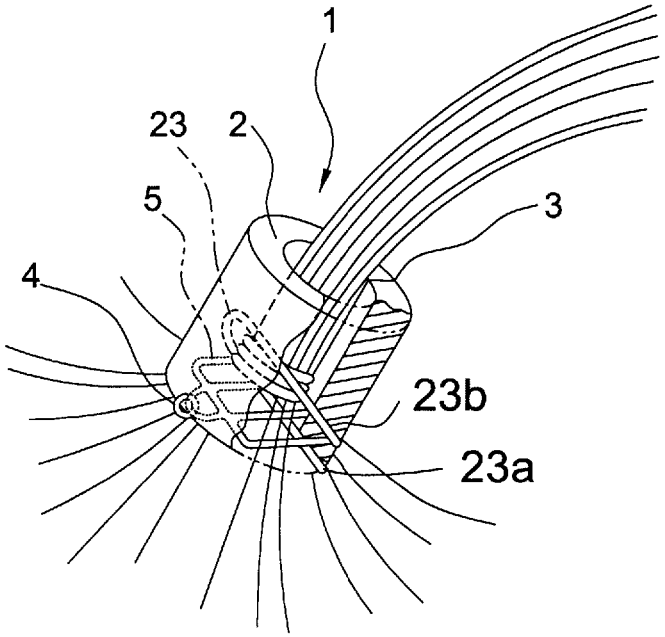
FIG. 2 is a perspective view of the hair bundling core structure which is fixed on a head.

As shown in FIG. 1, a hair bundling core structure 1 has an elastic cylinder 2 made of a foamed synthetic resin such as polystyrene foam or urethane foam, etc. Said elastic cylinder made of the foamed synthetic resin has a thickness and strength which are sufficient for facilitating an piercing of a hair setting U-shaped pin 23 as shown in FIG. 2, and an extraction of the U-shaped pin from the elastic cylinder and are capable of fixing hair to the elastic cylinder by the piercing of the U-shaped pin. A through hole for letting the hair bundle of a user is defined by an inside of the elastic cylinder 2. The elastic cylinder is capable of being cut by an cutting instrument such as a pair of scissors. Said elastic cylinder 2 has a rift 3 which is provided from a top end surface of the elastic cylinder to a lower end surface thereof. Said hair bundling core structure also has an attachment member 4 which is provided at the lower end portion of the elastic cylinder 2, and a hair fastening pin 5 which is connected to the elastic cylinder by means of the attachment member 4.

A preferable example of the elastic cylinder 2 may be sized to have a length of about 4 centimeters, an external diameter of about 5 centimeters, and a thickness of about 1 centimeter for achieving an easiness in using the elastic cylinder. Of course, the length and size may be larger, if required, in accordance with the type of the bundled hairdo to be made. The hair bundling core structure may have, in stead of the elastic cylinder 2, an elastic bar having a through hole which is penetrating from the upper end surface of the elastic bar to the lower end surface of the same.

The attachment member 4 is provided or appended at the lower end portion of the elastic cylinder 2 at a side diametrically opposite to the rift 3. The attachment member may preferably be formed by a body which can penetrate the elastic cylinder 2. The body may preferably be a ring made of metal or plastic. In another preferable embodiment, an attachment hole is provided in the elastic cylinder in a position where the attachment member is to be provided, and the attachment member, which may be formed by a rubber ring, is appended through the attachment hole.

The hair fastening pin 5 may be made of a rust-resisting material such as stainless steel, aluminium, or iron with an anti-corrosively treated surface. The fastening pin may also be made of plastic. The hair fastening pin 5 comprises a base 5*a* or basal rod, from which a plurality of parallel shafts 5*b* for thrusting into the hair bundle are extending into one direction, and a fixing element 5*c* for fixing the hair fastening pin to the attachment member 4, is protruding into an opposite direction. The above mentioned attachment member 4 allows the hair fastening pin 5 to move between a first position in which the plurality of shafts 5*b* tend into a direction generally parallel to an axis of the elastic cylinder as shown in FIG. 1 and a second position in which the shafts tend into a direction perpendicular to the axis as shown in FIG. 2. For omitting the fixing element 5*c*, the base 5*a* may be supported directly by the ring-shaped attachment member 4. If desired, the base 5*a* may be supported by the attachment member through another ring member. Although, the hair fastening pin has four shafts in the drawings, but the number of the shafts may be two, three, five, six or more.

Figure 3A:
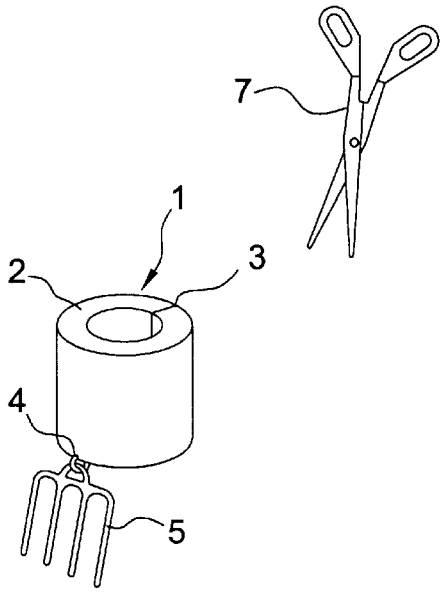
FIGS. 3A, 3B, 3C, and 3D are views of the hair bundling core structures in mounted positions.

Hereinafter, the method of using the hair bundling core structure 1 is explained in accordance with the FIG. 3. As shown in FIG. 3A, the elastic cylinder is cut by a cutting instrument 7 such as a pair of scissors or a cutter to form the rift 3, when the elastic cylinder 2 with no rift is used. Of course, the elastic cylinder with the rift 3 formed in advance may be used.

Figure 3B:
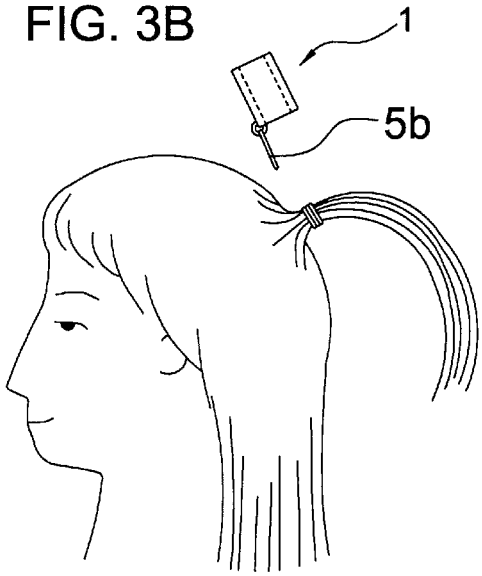

Initially, as shown in FIG. 3B, the operator should set hairs in a preset range of a head into a hair bundle, and bind the root portion of the bundle with a fastening instrument such as a rubber string for forming the base of the hairdo.

Figure 3C:
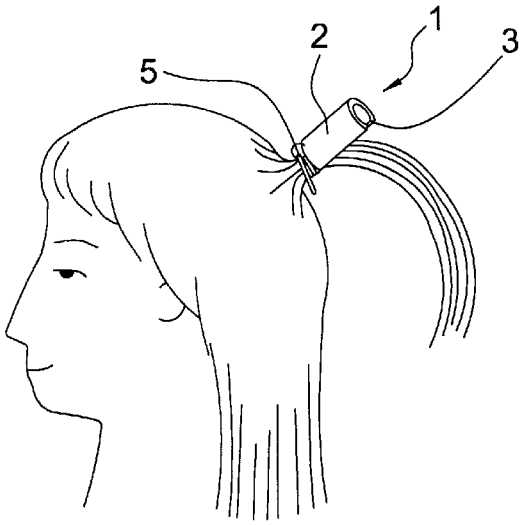
Figure 3D:
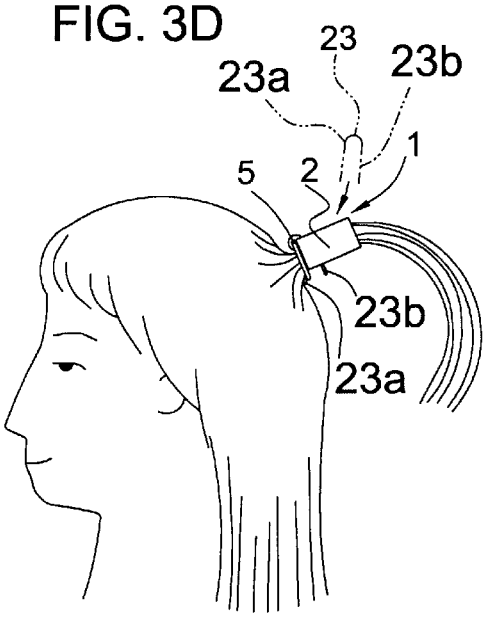

The shafts 5*b* of the hair fastening pin are, when they are parallel to the axis of the elastic cylinder in the first position as shown in FIG. 3B, thrusted into the root portion of the hair bundle. Then, the rift 3 of the elastic cylinder 2 is opened and the elastic cylinder 2 is turned on the attachment member 4 into the second position in which the shafts are perpendicular to the axis as shown in FIG. 3C, such that the hair bundle is entered into the elastic cylinder through the open rift, and the hair bundling core structure 1 is installed on the hair bundle. Then, a leg 23*a* of the U-shaped pin 23, depicted in an imaginary line in FIG. 3D, is thrusted below the hair fastening pin which fastens the root portion, while the other leg 23*b* is pierced into the elastic cylinder 2, such that the hair bundling core structure 1 is fixed on the hair of the head.

Figure 4A:
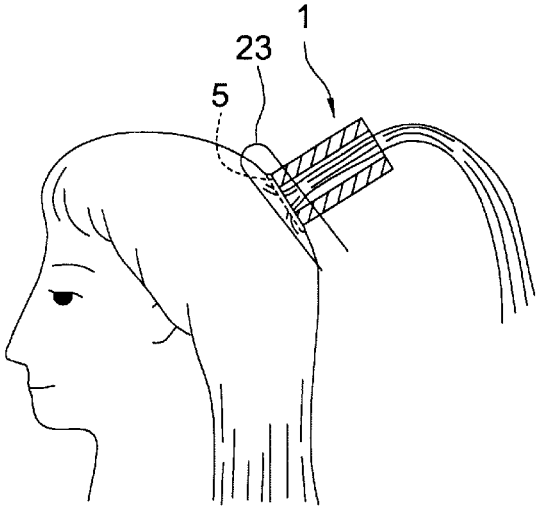
FIGS. 4A, 4B, 4C, and 4D are views, each showing how the hair bundling core structure is used for setting a bundled hairdo.

The hair bundling core structure 1, after being fixed to the hair of the head, may be used for making preferable types of the bundled hairdo, some of which are exemplified hereinafter. In FIG. 4A, a part of the hair bundle is protruding from the upper end of the hair bundling core structure 1 which is fixed on the head. And then, the protruding part of the hair bundle is wound around the hair bundling core structure 1 and fixed thereon by piercing the U-shaped pin (not shown in FIG. 4B) into the elastic cylinder 2.

Figure 4B:
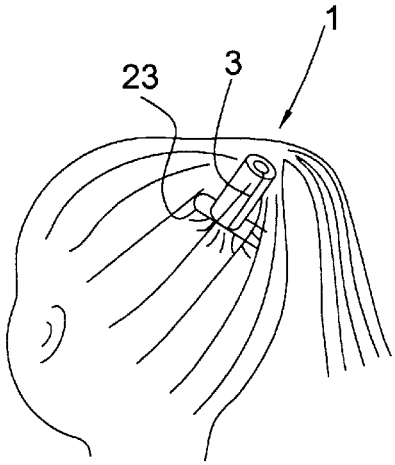

After that, for making a ponytail as shown in FIG. 4B, the hair tresses other than the hair bundle are gathered towards the hair bundling core structure 1 and bound above the structure by means of a rubber string, for example.

Figure 4C:
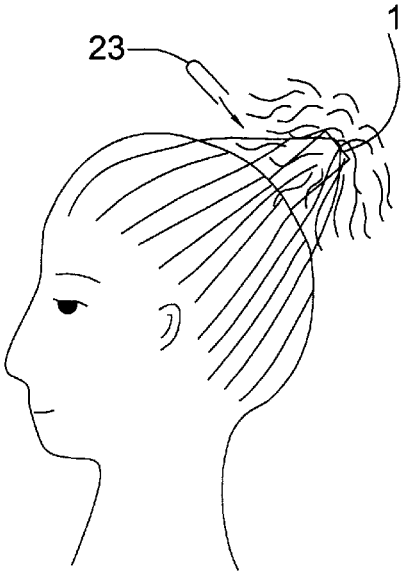

Moreover, the tail portion of the ponytail may be brought back to the hair bundling core structure and fixed thereon, as shown in FIG. 4C, by piercing another U-shaped pin 23 into the elastic cylinder 2 through the gathered hairs at a desired position, such that another, chignon-shaped hairdo is made.

Figure 4D:
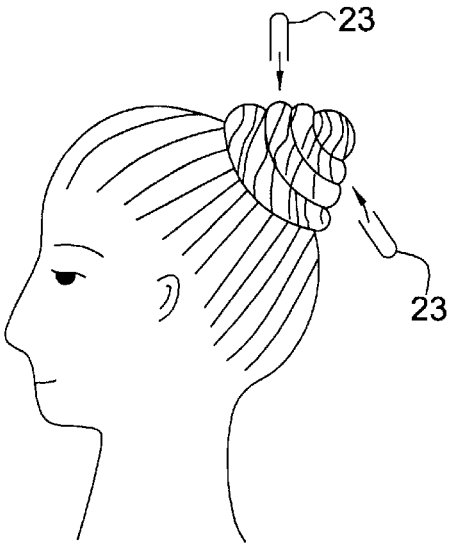

FIG. 4D shows a turned up hair, which is simply sustained by piercing the U-shaped pin 23 through the hair tresses into the elastic cylinder 2 at any desired position.

Figure 5:
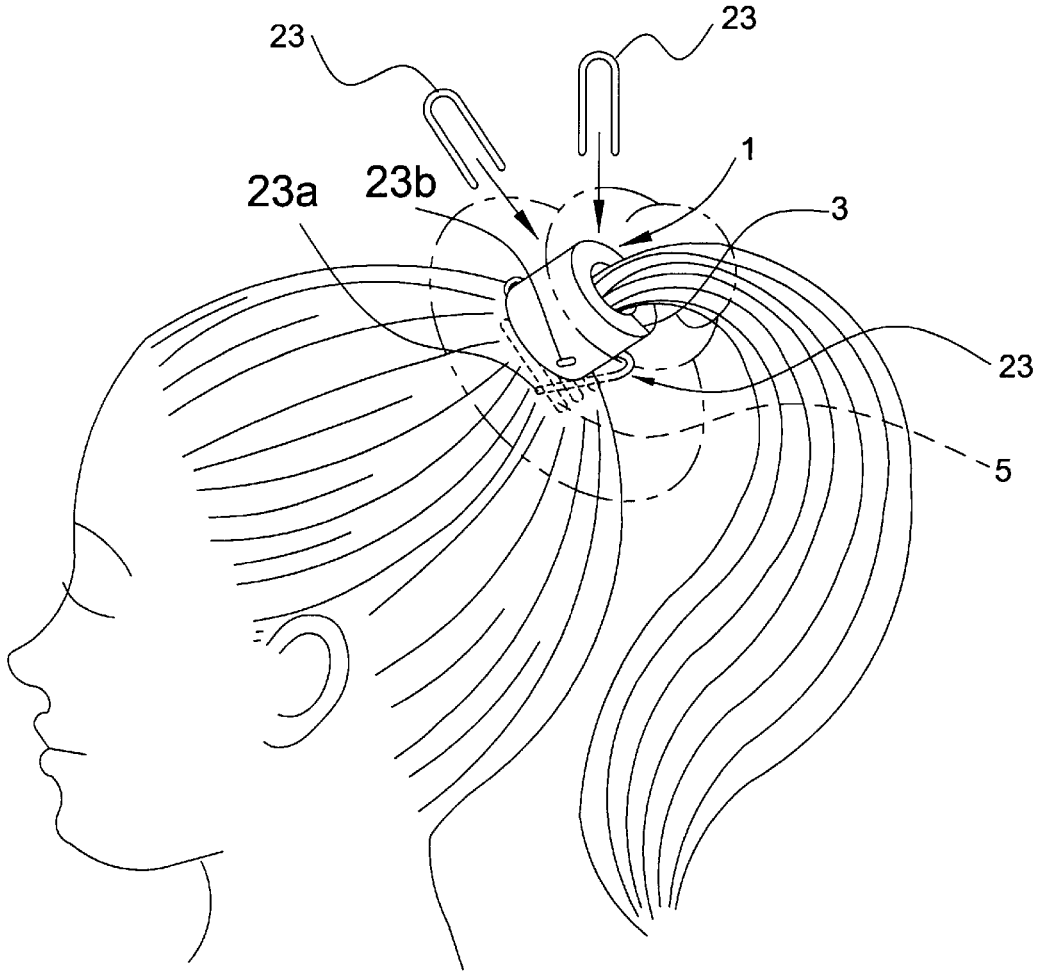
FIG. 5 is a perspective view showing an example of the use of the hair bundling core structure.

FIG. 5 shows another preferable usage of the hair bundling core structure 1, in which the whole of the hairs are set into a hair bundle to be used as the base of the hairdo. In this usage, the whole of the hairs are gathered into a ponytail-like hair bundle and bound at the root portion thereof by means of a rubber for example. Next, the hair fastening pin 5 of the hair bundling core structure is thrusted into the root portion, and the rift 3 of the elastic cylinder 2 is forced to open against an elasticity of the elastic cylinder for inserting the hair bundle thereinto, such that the elastic cylinder is installed on the hair bundle. The hair bundling core structure is set on the hair of the head by thrusting one leg 23*a* of the U-shaped pin 23 into the root portion below the hair fastening pin 5 and by piercing the other leg 23*b* into the elastic cylinder 2.

Furthermore, the part of the hairs protruding from the upper end of the elastic cylinder 2 are wound around the elastic cylinder 2, as depicted in imaginary lines, and the U-shaped pin 23 is pierced into the elastic cylinder 2 through the hairs, such that the bundled hair style is completed.

FIG. 6 shows preferable embodiments of various modified rifts 3. The explanation on the attachment member and the hair fastening pin are omitted, since they are equal to those in the previous embodiment.

Figure 6A:
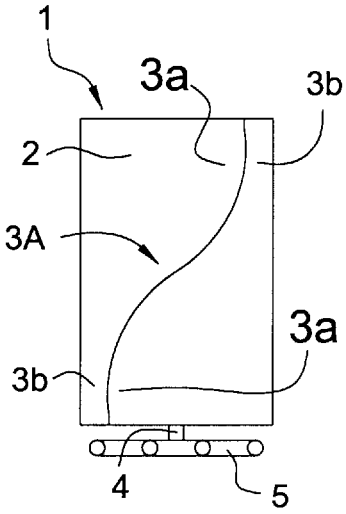
FIGS. 6A, 6B, 6C, 6D and 6E are front views of the hair bundling core structures, each having a modified rift.

As shown in FIG. 6A, a rift 3A is formed into an uneven curved line defined by a plurality of projections 3*a* and depressions 3*b*, such that the initial end and the terminating end of the rift 3A are located at circumferentially different positions. By providing such uneven rift, it is possible to prevent the hair bundle from protruding out from the hair bundling core structure, when the hair bundle tends towards the rift to escape outside therefrom, such that the handling of the hair bundle is facilitated.

Figure 6B:
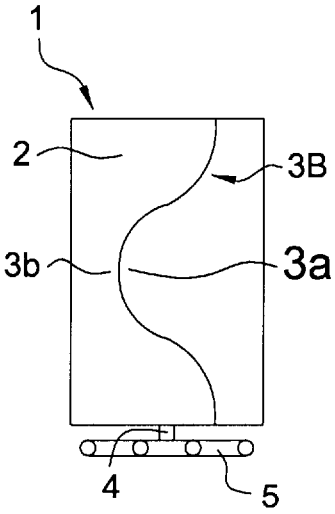

As shown in FIG. 6B, a rift 3B is formed into an uneven curved line defined by a plurality of projections 3*a* and depressions 3*b*, such that the initial end and the terminating end of the rift 3B are located at circumferentially same positions.

Figure 6C:
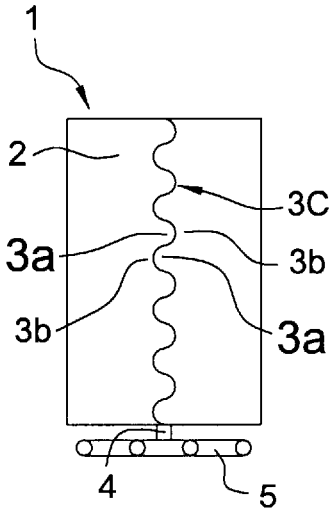
Figure 6D:
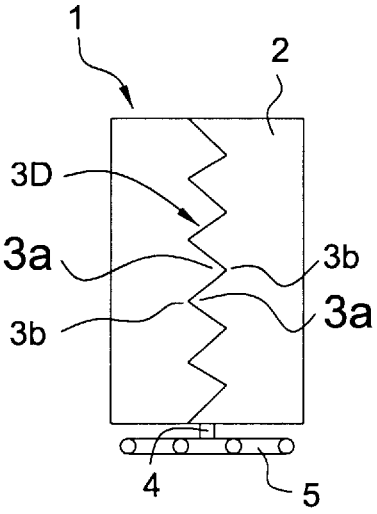
Figure 6E:
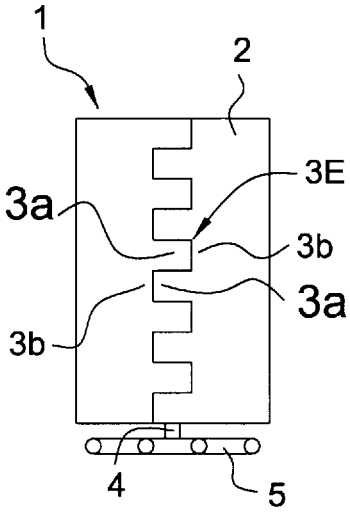

FIG. 6C shows a rift 3C formed into an undulating line defined by projections 3*a* and depressions 3*b*. FIG. 6D shows a rift 3D defined by generally triangular-shaped projections 3*a* and depressions 3*b*. FIG. 6E shows a rift 3*e* defined by generally square or rectangular-shaped projections 3*a* and depressions 3*b*.

FIG. 7 and FIG. 8 show preferable embodiments of various modified elastic cylinders and elastic bars of the hair bundling core structure. The rift, the attachment member, and the hair fastening pin are the same in the previous embodiment.

Figure 7A:
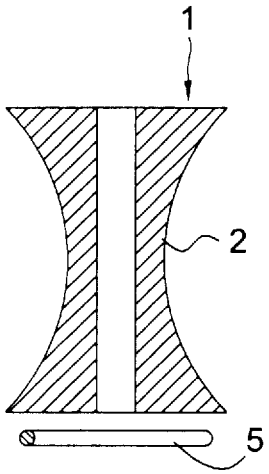
FIGS. 7A, 7B, 7C, 7D and 7E are sectional views of the hair bundling core structures, each showing the elastic cylinder in modified embodiments.
Figure 7B:
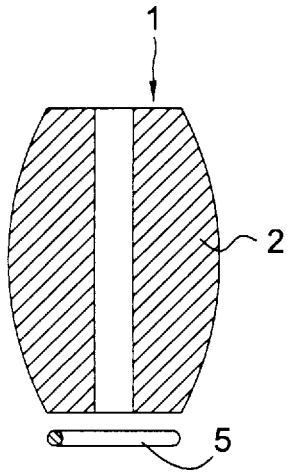
Figure 7C:
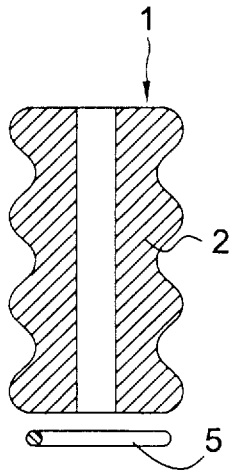
Figure 7D:
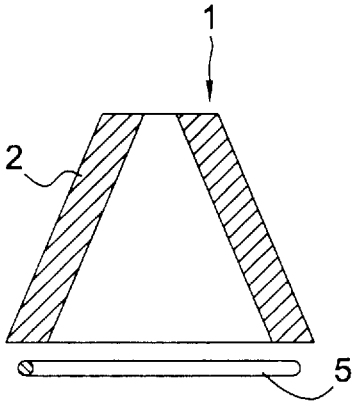
Figure 7E:
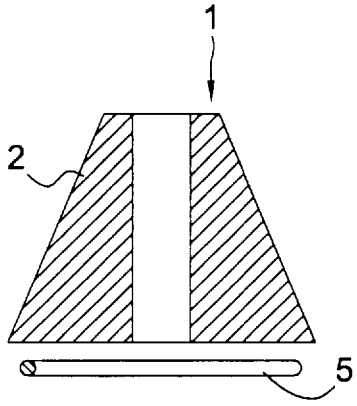

The elastic cylinder 2 may have a contracted middle portion and diametrically larger end portions as shown in FIG. 7A, or a barrel-shape as shown in FIG. 7B, or a corrugating outside as shown in FIG. 7C, or a frustum shape with its diameter being larger in the lower end than the upper end thereof as shown in FIG. 7D or FIG. 7E. The elastic cylinder shown in FIG. 7E increases its thickness from the upper end to the lower end thereof. The frustum elastic cylinder has an increased area to which the U-shaped pin can be pierced for facilitating the piercing of the U-shaped pin and the fixing of hairs thereto.

FIG. 8 shows the non-circular or polygonal sections of the preferable elastic cylinders or elastic bars.

Figure 8A:
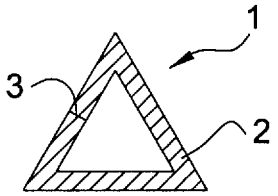
FIGS. 8A, 8B, 8C, 8D, 8E and 8F are end views of the hair bundling core structures, each showing the elastic cylinder or the elastic bar in the other modified embodiments.
Figure 8B:
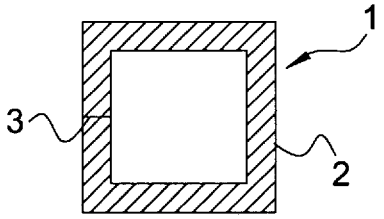

The elastic cylinder 2 may be shaped into a triangular section as shown in FIG. 8A, or a square section as shown in FIG. 8B. The rift 3 is extending vertically at widthwise center of the one side of the triangle or the square.

Figure 8C:
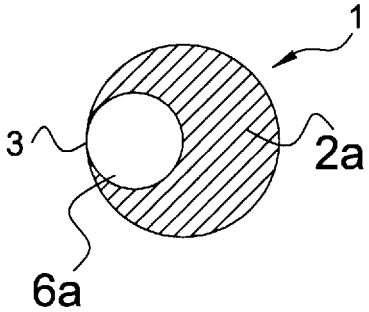

FIG. 8C shows an elastic bar 2*a* having the rift 3 which is provided, at its prescribed position, from the upper end surface of the elastic bar to the lower end surface of the same. A circular through hole 6a is extending along an inner edge of the rift from the upper end surface of the elastic bar to the lower end surface of the same and is preferably positioned eccentrically. The elastic bar is made of a foamed synthetic resin, such as polystyrene foam or urethane foam etc., which is capable of facilitating an piercing of the U-shaped pin 23 and the extraction of the same from the elastic bar, and of fixing the hair thereto by the piercing of the U-shaped pin.

Figure 8D:
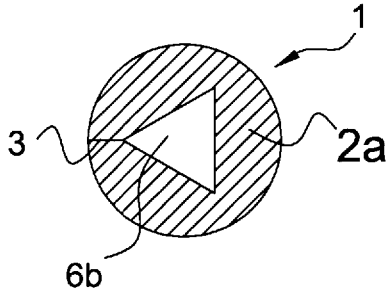

The elastic bar 2*a* may be shaped into a circular-section and has a triangular through hole 6*b* which is provided along an inner edge of the rift 3 as shown in the FIG. 8D. The elastic bar 2*a* may also have a notched groove 13 as shown in the FIG. 8D, or a cutting line 13*a* shown in FIG. 8F and acting as the notched groove. The notched groove or the cutting line 13*a* is extending from the upper end surface of the elastic bar to the lower end surface of the same.

Figure 8E:
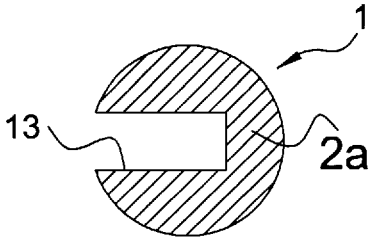
Figure 8F:
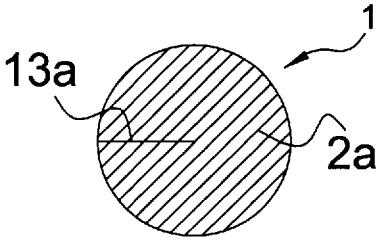

The widths and shapes of the notched grooves 13, 13*a* in FIGS. 8E and 8F may be varied at one's option. The notched groove with small width is suitable for a case in which the amount of the hairs in the hair bundle from the base of hairdo (shown in FIG. 2) is small in accordance with the amount of hairs to be treated and the type of hair style. For use, the notched grooves 13, 13*a* are opened laterally against the elasticity of the elastic bar to form a space, in which the hair bundle is clamped.

The elastic cylinder 2 or the elastic bar 2*a* may have any other preferable shape other than the aforementioned ones, for example, polygonal section such as pentagonal or hexagonal section, and also trapezoid, parallelogrammic, or rhombic section. The through hole may have a non-circular section or any polygonal section such as square; pentagonal. The notched grooves may be shaped into a triangle, a trapezoid, or a circular arc.

FIG. 9 shows preferable embodiments of various modified attachment members of the hair bundling core structure. The other parts are equal to those in the previous embodiments.

Figure 9C:
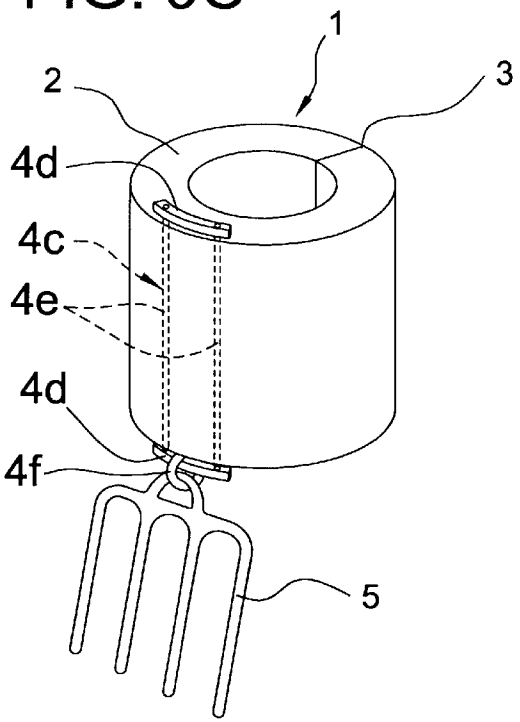
FIGS. 9A, 9B, 9C are perspective views of the hair bundling core structures, each showing the modified attachment member.
Figure 9B:
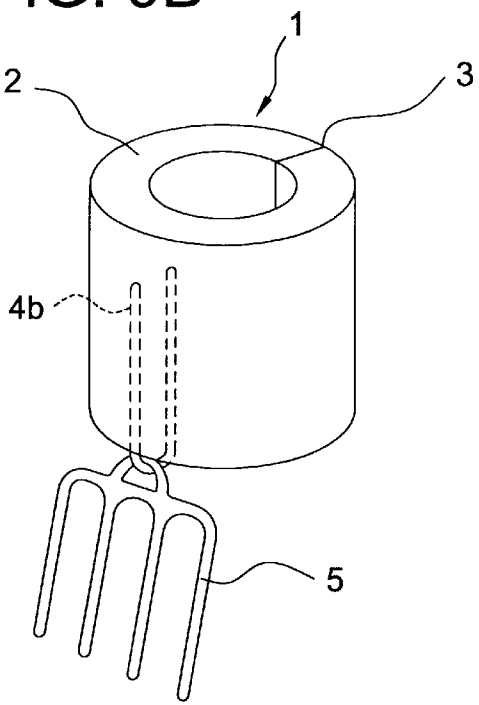
Figure 9A:
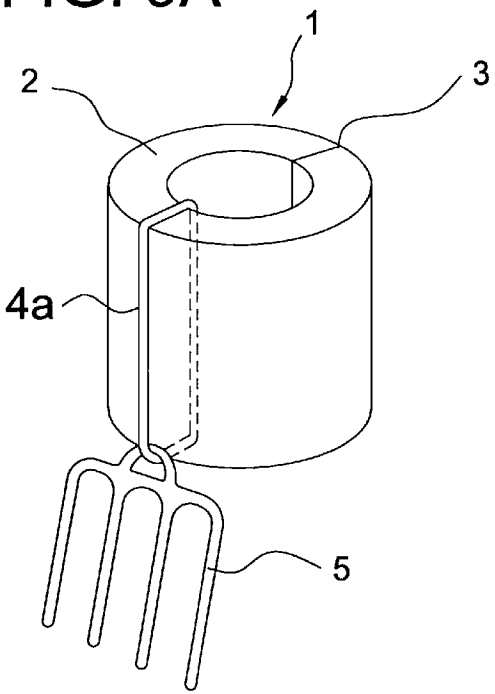

In the FIG. 9A, an attachment member 4*a* is formed into a loop or an annular member and extending along the outer surface of the side wall of the elastic cylinder.

In the FIG. 9B, an attachment member 4*b* is formed into an U-shape for piercing a thick wall of the elastic cylinder upwardly from the bottom thereof, and the hair fastening pin is linked or connected with the attachment member.

In the FIG. 9C, an attachment member 4*c* comprises a pair of upper and lower supporting elements 4*d*, 4*d* and a pair of connecting needles 4*e*, 4*e* which are supported by the supporting elements and penetrating a thick wall portion of the elastic cylinder. The hair fastening pin 5 is attached to the lower supporting element 4*d* by means of an annular member 4*f*.

The attachment members 4*a*, 4*b*, 4*c* may be made of metal, plastic etc. The attachment member 4*a* and 4*c* may also be made of rubber.

FIG. 10 shows preferable embodiments of various modified hair fastening pins of the hair bundling core structure.

Figure 10A:
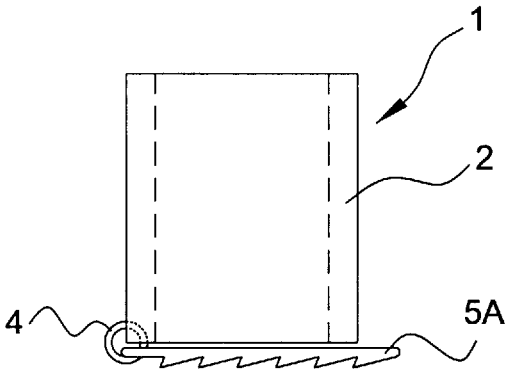
FIGS. 10A, 10B, 10C and 10D are side views of the hair bundling core structures, each showing the modified hair fastening pin.

In the FIG. 10A, each shaft of a hair fastening pin 5A is provided at its undersurface with a plurality of triangular protrusions and recesses alternating in its lengthwise direction. When the hair fastening pin 5A is thrusted into the root portion of the hair bundle, these protrusions and recesses provide engagements with the one leg 23*a* of the U-shaped pin (shown in FIG. 2) which is thrusted below the hair fastening pin so as to fix the leg, and also facilitate the thrusting of the leg.

Figure 10B:
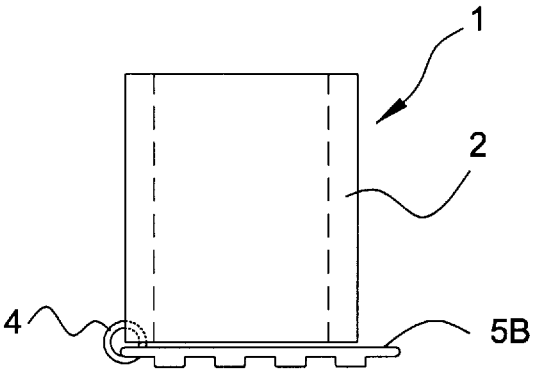

In the FIG. 10B, each shaft of a hair fastening pin 5B is provided at its undersurface with a plurality of rectangular protrusions and recesses.

Figure 10C:
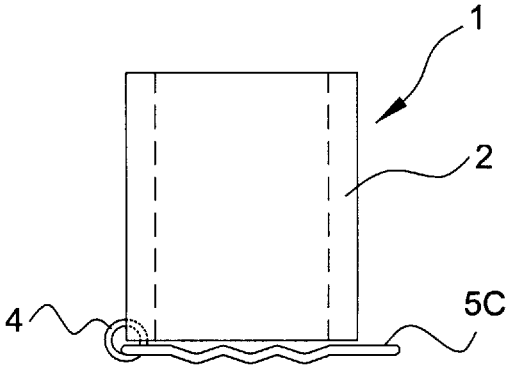

In the FIG. 10C, each shaft of a hair fastening pin 5C is bent or crimped to have alternating protrusions and recesses for facilitating the fixing and thrusting of the one leg 23*a* of the hair fastening pin 23.

Figure 10D:
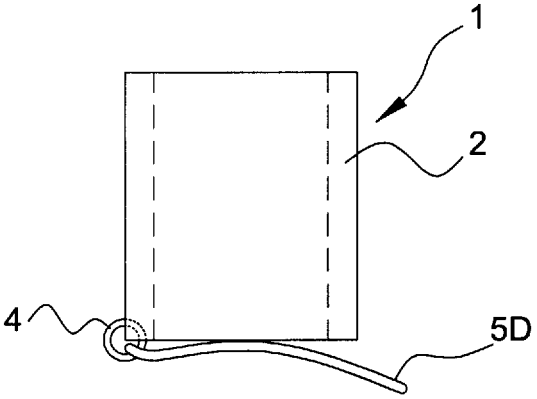

In the FIG. 10D, each shaft of an hair fastening pin 5D is so curved generally along the curvature of user's head, such that the middle portion of the shaft protrude towards the bottom of the elastic cylinder 2, in the shown position in which these shafts are perpendicular to the axis of the elastic cylinder. The curved shafts facilitate the fixing and thrusting of the one leg 23*a* of the U-shaped pin 23.

These hair fastening pins 5A, 5B, 5C, 5D may be preferably made of metal, plastic, etc.

Figure 11A:
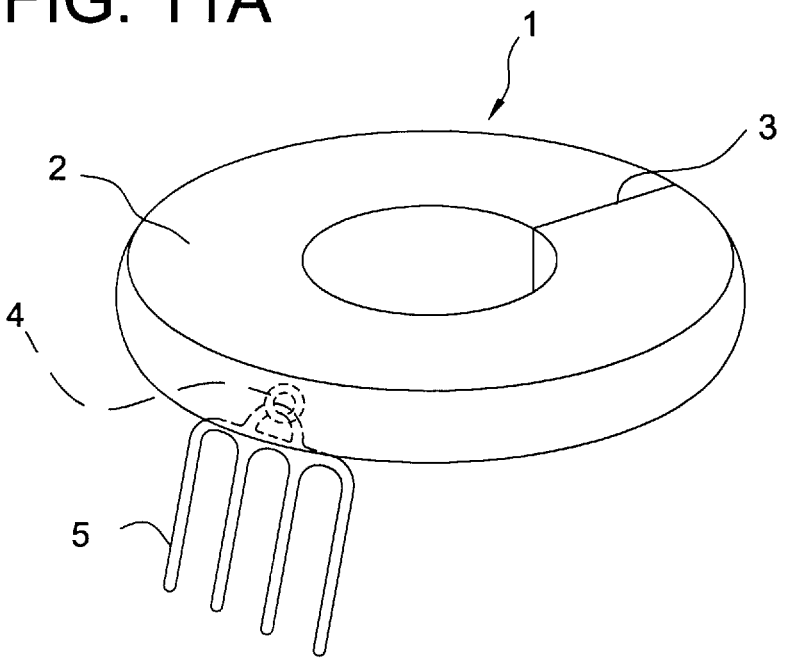
FIGS. 11A and 11B are perspective views of the modified hair bundling core structures.
Figure 11B:
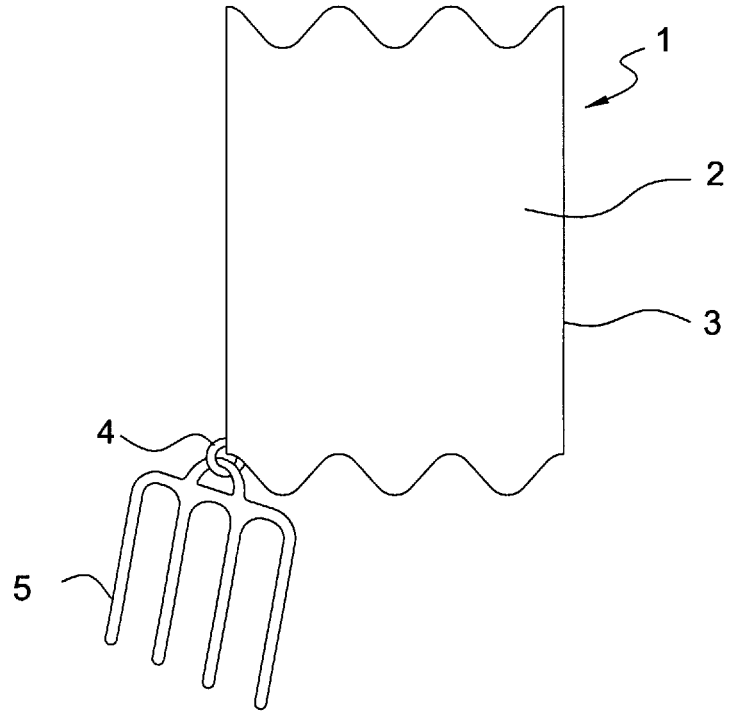

FIGS. 11A and 11B show other preferable embodiments of the hair bundling core structures.

In FIG. 11A, the elastic cylinder 2 is formed into an annular or a doughnut-like shape, and split by the rift 3 at one side. This cylinder is suitable for giving variety to the hair style.

In FIG. 11B, the elastic cylinder 2 has upper and lower end circumferences, each of which is provided with a plurality of ridges and valleys alternating along the circumference for increasing the stability of the elastic cylinder, when it is installed on the head.

Figure 12A:
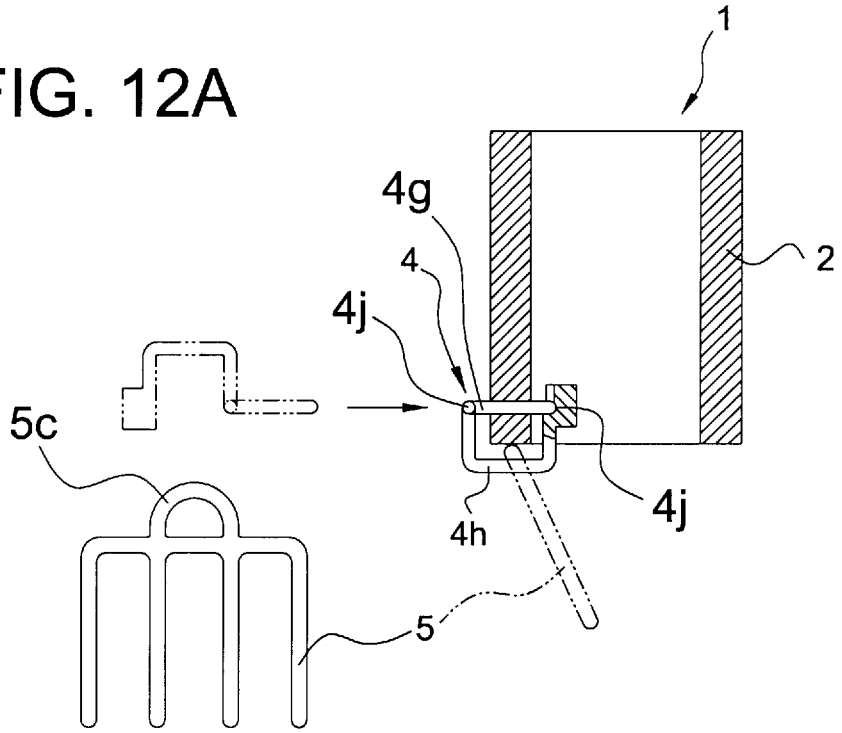
FIG. 12A is a partly section side view of the hair bundling core structure with a removable attached hair fastening pin.
Figure 12B:
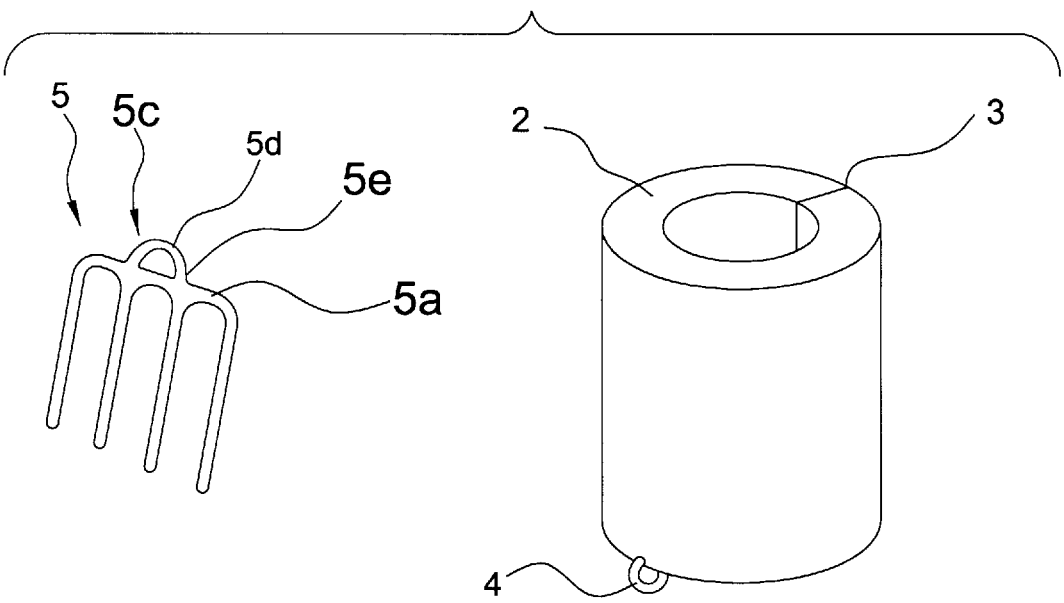
FIG. 12B is a perspective view of the core structure with the other removable hair fastening pin.

FIGS. 12A and 12B show other preferable embodiments on the hair fastening pin 5 removably attached to the attachment member 4.

In FIG. 12A, the attachment member 4 is formed by a pin element 4*g* for piercing into the elastic cylinder 2, a suspending rod element 4*h* which is pivotably connected to a base end of the pin element 4*g* by means of a pivot part 4*i*, and an engagement end element 4*j* which is formed by a leading end of the suspending rod element 4*h*.

The hair fastening pin 5 can be removably attached to the attachment member by piercing the pin element 4*g* into the lower portion of the elastic cylinder 2 at the side opposite to the rift 3, and attaching the fixing element 5*c* of the hair fastening pin 5 to the suspending rod element 4*h*, and rotating the suspending rod element 4*h* so as to engage the engagement end element 4*j* to the leading end of the pin element 4*g*.

In FIG. 12B, the fixing element 5*c* is formed by a pair of longer and shorter supporting pins 5*d*, 5*e*. The longer supporting pin 5*d* is curved to meet with the shorter supporting pin 5*e*, and adapted to separate apart from the shorter one by elastically spreading so as to fix the pins to the attachment member 4.

The removable hair fastening pin 5 can be used over and over by removing it from the old elastic cylinder and attaching it to a new one, when the elastic cylinder 2 is deteriorated by repeating the piercing of the U-shaped pin or broken by some other reason. Needless to say, the hair fastening pin can be removably attached to the elastic bar instead of the elastic cylinder.

The above-mentioned parts of the hair bundling core structures can be used in combination in a preferred manner. The foamed synthetic resin of the hair bundling core structure may be an open-cell foam or a foam in which closed cells and open cells are mixed. In the use of the foam in which the open cells are contained, the hair bundling core structure has high air-permeability, preventing mustiness. Moreover, the through hole of the elastic cylinder or the elastic bar may be located at an eccentric position. Furthermore, the hair bundling core structure may be used as a hair ornament as shown in solid lines in FIG. 5, by installing the structure in an exposed position.

The hair fastening pin may be made of wires by bending them. For example, each wire is bent such that the leading end portion of the shafts of the hair fastening pin is defined by the bent portion of the wire. The wires are wounded each other at the base portion of the hair fastening pin for shaping the hair fastening pin as it is shaped in FIG. 1. The number of the shafts may be more than seven.

I claim:

1. A hair bundling core structure comprising:

an elastic cylinder made of a foamed synthetic resin having a thickness and strength which are sufficient for facilitating a piercing of a hair fixing U-shaped pin and an extraction of the U-shaped pin from the elastic cylinder and capable of fixing hair to the elastic cylinder by the piercing by the U-shaped pin, the synthetic resin capable of being cut;

the elastic cylinder having a rift from a top end surface to a lower end surface;

a hair fastening pin connected to a lower end portion of the elastic cylinder by an attachment member;

wherein a through hole for letting a hair bundle of a user is defined by an inside of the elastic cylinder, the hair fastening pin comprising a plurality of parallel shafts for thrusting into the hair bundle.

2. The hair bundling core structure of claim 1;

wherein the hair fastening pin and the rift are at opposite sides of the elastic cylinder;

and the hair fastening pin is allowed to move between a first position in which the plurality of shafts are parallel to the axis of the elastic cylinder and a second position in which the shafts are perpendicular to the axis.

3. The hair bundling core structure of claim 1, wherein one of the end surfaces is larger in diameter than the other of the end surfaces.

4. The hair bundling core structure of claim 1, wherein the elastic cylinder has a pair of abutting portions separated by the rift, and each abutting portion has a depression and a projection.

5. The hair bundling core structure of claim 1, wherein each shaft of the hair fastening pin has a plurality of protrusions and recesses alternating in its lengthwise direction.

6. The hair bundling core structure of claim 1, wherein each shaft of the hair fastening pin is curved.

7. The hair bundling core structure of claim 1, wherein the hair fastening pin is removably connected to the attachment member.

8. A hair bundling core structure comprising:

an elastic bar made of a foamed synthetic resin which is capable of facilitating a piercing of a hair fixing U-shaped pin and an extraction of the U-shaped pin from the elastic bar for fixing hair to the elastic bar by the piercing of the U-shaped pin;

the elastic bar having a notched groove extending from a top end surface of the elastic bar to a lower end surface;

a hair fastening pin connected to a lower end portion of the elastic bar by an attachment member;

wherein the hair fastening pin comprises a plurality of parallel thrusting shafts.

9. The hair bundling core structure of claim 8, wherein the notched groove is formed into a rift, and further comprising a through hole extending along an inner edge of the rift from the top end surface of the elastic bar to the lower end surface.

10. The hair bundling core structure of claim 8, wherein one of the end surfaces is larger in diameter than the other of the end surfaces.

11. The hair bundling core structure of claim 9, wherein the elastic bar has a pair of abutting portions separated by the rift, each abutting portion having a depression and a projection.

12. The hair bundling core structure of claim 8, wherein each thrusting shaft has a plurality of protrusions and recesses alternating in its lengthwise direction.

13. The hair bundling core structure of claim 8, wherein each thrusting shaft is curved.

14. The hair bundling core structure of claim 8, wherein the hair fastening pin is removably connected to the attachment member.

15. A method of using a hair bundling core structure comprising an elastic cylinder with a rift extending from an upper end surface to a lower end surface, and a hair fastening pin connected to a lower end portion of the elastic cylinder by an attachment member, the hair fastening pin comprising a plurality of parallel shafts the method comprising the steps of:

setting hairs in a preset range of a head into a hair bundle having a root portion, and binding the root portion with a fastening instrument at the center of the preset range;

thrusting the shafts of the hair fastening pin into the root portion of the hair bundle;

opening the rift of the elastic cylinder and installing the elastic cylinder on the hair bundle;

fixing the core structure to the head by a U-shaped pin having a pair of legs, by thrusting one of the legs below the shafts of the hair fastening pin, and by piercing the other of the legs into the elastic cylinder.

16. A method of using a hair bundling core structure comprising an elastic cylinder and a hair fastening pin connected to the elastic cylinder by an attachment member, the hair fastening pin comprising a plurality of parallel shafts the method comprising the steps of:

cutting the elastic cylinder from an upper end surface of the elastic cylinder to a lower end surface to form a rift;

setting hairs in a preset range of a head into a hair bundle having a root portion, and binding the root portion with a fastening instrument at a center of the preset range;

thrusting the shafts of the hair fastening pin into the root portion of the hair bundle;

opening the rift of the elastic cylinder and installing the elastic cylinder on the hair bundle;

fixing the core structure on the head by a U-shaped pin having a pair of legs by thrusting one of the legs below the shafts of the hair fastening pin, and by piercing the other of the legs into the elastic cylinder.

* * * * *